US005421580A

United States Patent [19]

Sugimoto et al.

[11] Patent Number: 5,421,580

[45] Date of Patent: Jun. 6, 1995

[54] THREAD WOUND GOLF BALLS

[75] Inventors: Kazushige Sugimoto; Keiji Moriyama, both of Akashi; Tadahiro Ebisuno, Nishinomiya; Mikio Yamada, Kobe, all of Japan

[73] Assignee: Sumitomo Rubber Industries, Ltd., Hyogo, Japan

[21] Appl. No.: 231,062

[22] Filed: Apr. 22, 1994

[30] Foreign Application Priority Data

Apr. 27, 1993 [JP] Japan ..... 5-124944

[51] Int. Cl.[6] ..... A63B 37/08; A63B 37/14

[52] U.S. Cl. ..... 273/227; 273/231; 273/232

[58] Field of Search ..... 273/225, 226, 227, 230, 273/231

[56] References Cited

U.S. PATENT DOCUMENTS

| | | | |
|---|---|---|---|
| 5,020,803 | 6/1991 | Gondreau et al. | 273/225 |
| 5,033,749 | 7/1991 | Kakiuchi et al. | 273/231 X |
| 5,338,038 | 8/1994 | Cadorniga | 273/231 X |

FOREIGN PATENT DOCUMENTS

| | | |
|---|---|---|
| 0389213 | 9/1990 | European Pat. Off. . |
| 2127304 | 4/1984 | United Kingdom . |
| 2182571 | 5/1987 | United Kingdom . |
| 2202154 | 9/1988 | United Kingdom . |
| 2229641 | 10/1990 | United Kingdom . |

*Primary Examiner*—George J. Marlo

*Attorney, Agent, or Firm*—Birch, Stewart, Kolasch & Birch

[57] ABSTRACT

Disclosed is a thread wound golf ball comprising a liquid center, rubber thread layer formed on said liquid center, and a cover covering said rubber thread layer wherein said liquid center has a diameter of 29.5 to 32 mm and said cover has dimples thereon which have total dimple volume of 280 to 340 $mm^3$.

10 Claims, 1 Drawing Sheet

THREAD WOUND GOLF BALLS

FIELD OF THE INVENTION

The present invention relates to a thread wound golf ball. More particularly, it relates to a thread wound golf ball which is designed to provide low spin and increase flying distance.

BACKGROUND OF THE INVENTION

Conventionally, for thread wound golf balls, well known are those in which a core is formed by winding highly expanded rubber thread around a spherical liquid center and a cover with dimples is coated on the rubber thread layer and, then, press-formed into thread wound golf balls. For the liquid center, a hollow section of the hollow spherical center bag comprising rubber, etc. is filled with a liquid containing water or a specific gravity adjusting agent.

The functions required for golf balls include large flying distance and easy ball control. The thread wound golf balls allow larger backspin and ensure better controllability than two-piece solid golf balls, but have disadvantage of shorter flying distance than two-piece solid golf balls.

In the present market, average golfers who want a longer carry prefer two-piece solid golf balls which carry well, and advanced and professional golfers with small handicaps give more emphasis on controllability than flying distance and generally prefer to use thread wound golf balls (particularly balata-covered thread wound golf balls).

In order to increase controllability of two-piece solid golf balls, development has been made to soften the cover and to give the ball a spin like thread wound golf balls. Development has also been made to increase the flying distance of the thread wound golf balls.

However, because increasing the initial speed of balls by increasing the impact resilience of rubber is restricted by the initial-speed upper limit specified by the golf ball specifications, an increase in the flying distance by increasing the initial speed has its own limit.

Consequently, it is necessary to increase flying distance by any other means than increasing initial speed by increasing rubber impact resilience, such as improving liquid center construction.

Therefore, the following description is made on the techniques which have been proposed to date with respect to the center of thread wound golf balls and those which have been actually adopted.

For the center of the thread wound golf ball, there are liquid centers and solid centers.

Since the solid center is a so-called rubber lump and easy to produce, it is proposed in Japanese Kokai Publication No. 48-4025 that the center diameter which used to be 25–28 mm should be increased considerably to 23–39 mm.

In Japanese Kokai Publication No. 59-129072, it is also proposed that the solid center diameter should be increased to 30–38 mm and the specific gravity be reduced while the material with large specific gravity should be used for the cover, thereby increasing the inertia moment and improving carry.

In Japanese Patent Publication No. 60-168471, it is proposed that the solid center diameter should be designed to be as large as 28–32 mm and the cover should be made harder, thereby increasing the delivery angle, reducing spin, and improving carry.

On the other hand, with respect to the liquid center, various researches have been carried out for a long time, and in the specification of British Patent 180,619 (filed in 1921), a method to fill a liquid paste in a spherical hollow section of a mold, refrigerate to make a pellet, cover it with rubber and press-cure, indicating that at that time a manufacturing method of a liquid center had already been developed. In this British patent specification, there is no description on the center diameter nor on dimples.

In the specification of U.S. Pat. No. 2,249,612 or Japanese Kokai Publication No. 48-4026, techniques to cover a liquid paste without refrigeration are disclosed, but in these specifications, there is no description on center diameter nor dimples.

Japanese Patent Publication No. 60-92782 describes that changing the center diameter which used to be 25.4–26.99 mm to 28.6±0.0076 mm has enabled to reduce spin, and Japanese Kokai Publication No. 60-165966 introduces an embodiment in which the center diameter is changed to 28.5 mm, and Japanese Kokai Publication No. 60-187875 recommends that the center diameter be 25–34 mm, preferably 26–30 mm, but these have no description on the combining technique with dimples, and if ever they have, golf balls have diameters of conventional techniques. Japanese Patent Publication No. 62-112575 describes that the center diameter be 20–35 mm, preferably 28–34 mm.

However, this center is formed with high moisture-content gel spherical substance and repeatedly subject to refrigeration, weathering, and defrosting in the manufacturing process. The center is thereby designed to be free from the cover and enabled to be directly wound with rubber thread, and therefore, it should belong to the category of solid center, rather than liquid center.

Japanese Kokai Publication No. 2-255162 describes that the liquid center should be made softer than the conventional one and a load required to deform the liquid center is designed to be lower than the conventional one, thereby reducing backspin and increasing a carry. It also describes that the center diameter is preferably set to 26–29 mm.

Japanese Kokai Publication No. 54-135037 proposes golf balls which use water glass for the center, which is not solid nor liquid, and describes that it is desirable to cover the water glass core 27–31 mm in diameter with a coating material having a thickness of 2 mm or less.

As described above, various proposals have been made in a large number of applications with respect to the center diameter, and researches related to the center diameter have a history of more than 70 years and it thus seems that everything has been already studied.

However, when the diameter of the liquid center of thread wound golf balls actually put into market is investigated, almost all diameters are included in the range of 25–29 mm, and in practice, this range is estimated to be most suited for the application.

This is attributed to the fact that the liquid center cannot hold hardness by the center itself as the solid center can, because the liquid is wrapped with a rubber bag only in the liquid center.

That is, when the center diameter is large, the consumption of rubber thread to be wound decreases, and as a result, a ball with suitable hardness is unable to be obtained, resulting in slower initial ball speed or preventing the ball from carrying high when it is hit. This would be the reasons why diameters greater than about 29 mm have not been adopted.

Of course, there has been proposed that the liquid center diameter be increased to 39 mm, but in actuality, there has been no actual example and it is an armchair theory. Investigation of commercially available golf balls with a liquid center indicates that the actually employed liquid center diameter is within the range of from 25 to 29 mm.

With respect to dimples, Japanese Kokai Publication No. 60-92782 mentioned above proposes the dimple depth and diameter at the center diameter of about 28.6 mm, but this does not exceed the limit of conventional technique as far as the center is concerned. Japanese Kokai Publication No. 54-4626 specifies the dimple of small thread wound balls with a solid center and describes that the desirable center diameter is 25–29 mm. This Japanese reference discloses a technique for optimizing the relationship between the construction and dimples to improve the flying characteristics of thread wound golf balls with solid-center construction, but small balls have presently scarcely been produced and the technique is related to the solid center and is intended for the industrial field different from that of the present invention which is applicable to the liquid center.

SUMMARY OF THE INVENTION

Under these circumstances described above with respect to thread wound golf balls using a liquid center, the object of the present invention is to provide thread wound golf balls with an increased flying distance without losing the good feeling and good controllability the thread wound golf ball provides and with the initial-speed limit range observed, and which even average golfers prefer to use.

In order to achieve the above object, the inventors of the present invention have made various investigations on the relationship between the physical properties of the liquid center of the thread wound golf ball and backspin and flying distance, and have reduced backspin by increasing the diameter of the liquid center to 29.5–32 mm, obtained the optimum trajectory by specifying the total dimple volume as 280–340 $mm^3$, and have achieved the above-mentioned objects by increasing the flying distance and completed the present invention.

DETAILED DESCRIPTION OF THE INVENTION

In the present invention, the liquid center diameter is increased to reduce backspin. With this technique, the disadvantage of conventional thread wound golf balls of the blowing up trajectory is corrected and a mild trajectory similar to that of two-piece solid golf balls (that is, trajectory much closer to a parabola) is obtained. And specifying the total dimple volume to 280–340 $mm^3$, an optimum loft is given to the ball. This has solved the difficulty of the ball to loft resulting from reduced backspin and enabled to obtain the optimum trajectory, and finally the flying distance has been increased.

In the present invention, the liquid center diameter is increased to 29.5–32 mm from the conventional one. The reason to increase the liquid center from the conventional one in this way is to reduce backspin and change the ball trajectory to that similar to the two-piece solid golf ball. The reason to set the upper limit of the diameter to 32 mm is that further increasing the liquid center diameter reduces the consumption of rubber thread for winding to obtain necessary hardness as golf balls and makes it difficult to obtain required hardness.

In the present invention, the total dimple volume is set to 280–340 $mm^3$. The reason to increase the total dimple volume from 280 $mm^3$ is to properly exert a loft to the ball and to solve the difficulty to climb due to the reduced backspin. The reason to specify the upper limit of the total dimple volume to 340 $mm^3$ is that when the total dimple volume exceeds 340 $mm^3$, the loft becomes short, the trajectory lowers and an enough flying distance is not obtained. For this total dimple volume, the range of 300–335 $mm^3$ is particularly preferable, and the number of dimples is, 350–450 pieces, preferably, 420±25 pieces.

As described in the above-mentioned prior art, conventional techniques related to thread wound balls have only specified the construction such as that of the center and there has been no example to refer to the carrying behavior of the ball when it is hit with a club, and in particular, there have scarcely been examples describing dimples. The present invention is a remarkable technical development in that sense, which has combined the construction believed to be unable to combine with carrying performance, achieved its optimization, and increased the flying distance of thread wound golf balls.

In the present invention, the total dimple volume has been found as follows:

Measuring Method of Total Dimple Volume

From the dimples on the ball surface, 20 to 30 dimples are optionally selected, on which the cross-sectional profile is measured by a pick-up type (contact type) surface profile measuring equipment as explained below, and based on the results, the volume of individual dimple is found, the total of dimples are proportionally calculated, and the total dimple volume is found.

Figure 1:
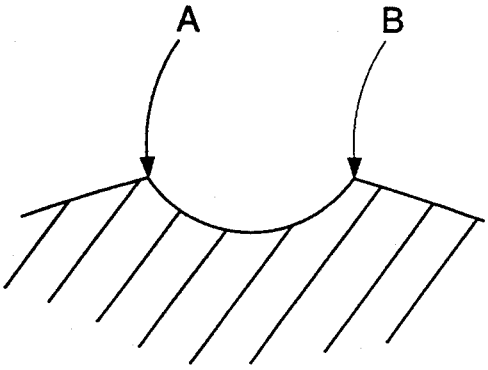
FIG. 1 shows a chart from one end A of the dimple to the other end B obtained by tracing the bottom of dimple cross section with a pick-up type surface profile measuring equipment in measuring the volume of dimples.
Figure 2:
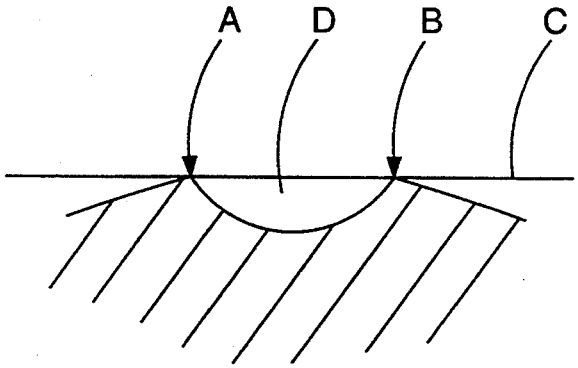
FIG. 2 shows a schematic diagram illustrated by drawing a tangent C which passes Points A and B in the chart shown in FIG. 1 and finding the volume of Area D surrounded by the relevant tangent C and the dimple bottom.

The individual dimple volume is measured by tracing the bottom of the dimple to be measured with a pick-up type surface profile measuring equipment, preparing a chart covering one end A to the other end B of the dimple as shown in FIG. 1, based on the results, plotting each point from this chart, drawing a tangent C which passes Points A and B as shown in FIG. 2, and finding the volume of Area D surrounded by the relevant tangent C and the dimple bottom.

Referring now to the drawings, the construction of the thread wound golf balls according to the present invention will be described as follows.

Figure 3:
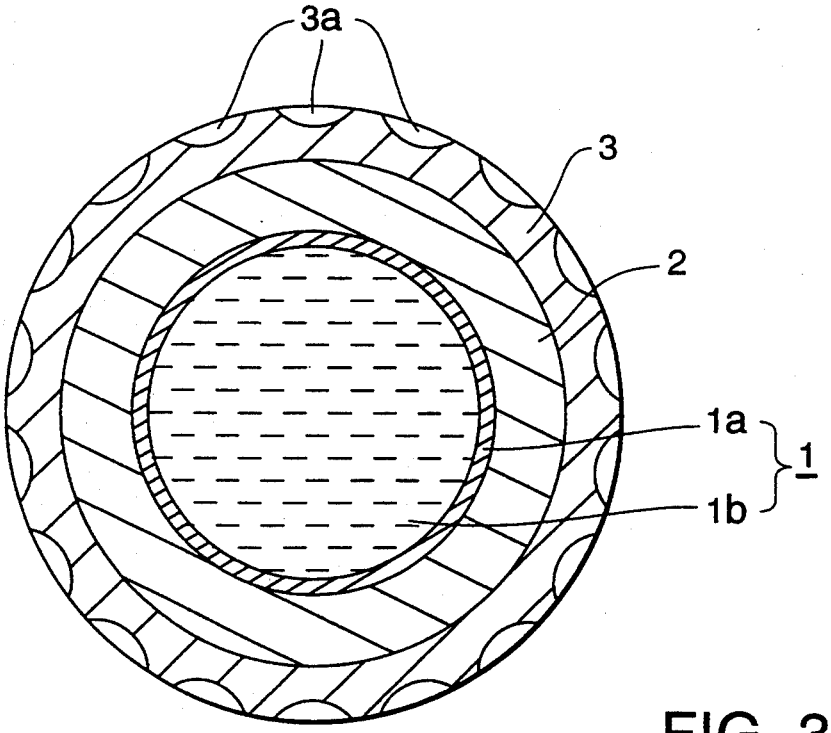
FIG. 3 is a cross-sectional drawing which schematically shows one example of a thread wound golf ball according to the present invention.

FIG. 3 is a cross-sectional drawing which schematically shows one example of a thread wound golf ball according to the present invention. In FIG. 3, numeral 1 is a liquid center, which comprises a center bag 1*a* to which liquid containing water or specific gravity adjusting agent 1*b* is injected, and in the present invention, the diameter of this liquid center 1 is designed to be 29.5–32 mm. Numeral 2 is a rubber thread layer 2, which is formed by winding rubber thread around the outer circumference of the above liquid center 1.

Numeral 3 is a cover, which covers a so-called rubber thread-wound core comprising the above liquid center 1 and rubber thread layer 2. To the cover 3, a multiplicity of dimples 3*a*, preferably 350–450 dimples, more preferably 420±25 dimples, are equipped. In the present invention, the total volume of this dimple 3*a* is specified to be 280–340 $mm^3$, preferably, 300–335 $mm^3$.

For the paste formulation to prepare the above liquid center (formulation of the paste forming the substance illustrated as liquid 1*b* in FIG. 3), formulation for center bag, formulation of rubber threads and covers, etc., any of those which are adopted to these applications can be employed. These are introduced as follows. However, these are only examples and are not to be constructed to limit the scope of the present invention.

(1) Paste Formulation for Liquid Center

| | |
|---|---|
| Water | 88 parts by weight |
| Glycerin | 12 parts by weight |
| Clay | 20 parts by weight |
| Barium sulfate | 50–150 parts by weight |

The reason to specify the compounding rate of barium sulfate in the above-mentioned range is that the specific gravity is adjusted as required according to the liquid center diameter so that the ball weight is 45.92 g or less, which is the specified golf ball weight. The specific gravity of this liquid paste is, in general, 1.1 or higher, or particularly preferably 1.3 or higher.

(2) Formulation for Center Bag

| | |
|---|---|
| Natural rubber | 100 parts by weight |
| Filler | 30 ± 10 parts by weight (Specific gravity is adjusted as required.) |
| Sulfur + curing accelerator | 4 parts by weight |

For the cover of this center bag, the amount of the filler is adjusted as required to adjust the specific gravity so that the ball weight is 45.92 g or less, the specified figure for golf balls. Examples of preferable fillers include calcium carbonate, barium sulfate, zinc oxide, etc.

The liquid center manufacturing method itself is not specifically limited, and it can be manufactured by any of conventionally accepted methods. The center bag thickness is preferably 1.5–2.0 mm and hardness of center bag after curing is preferably 40–60 by the JIS-A type hardness meter. The center curing conditions are preferably, for example, at 145°–165° C. and for 20–40 minutes, but they are not to be construed to particularly limit the scope of the present invention, and time and temperature should be adjusted as required to a specified hardness.

(3) Rubber thread

Elastic rubber thread 0.4–0.6 mm thick and 1.3–1.8 mm wide made from natural rubber and/or isoprene rubber is used.

In the present invention, because the liquid center diameter is designed to be increased, the consumption of rubber thread to be wound is decreased as much and the required hardness is difficult to achieve, and it is, therefore, desirable to securely wind rubber thread with a high stretching rate to achieve the required hardness. For rubber thread to achieve this purpose, for example, rubber thread comprising natural rubber and isoprene rubber, with a greater ratio of isoprene rubber, is preferable, and that containing natural rubber and isoprene rubber at the weight ratio of 20:80–50:50 is particularly preferable. The core diameter after winding rubber thread is preferable to be 39.8±0.5 mm.

(4) Formulation for Cover

| | |
|---|---|
| Resin | 90 parts by weight |
| Natural rubber | 10 parts by weight |
| Filler | 18 parts by weight |
| Sulfur + accelerator | 2 parts by weight |

For the above resin, synthetic trans-polyisoprene, gutta-percha, balata, high styrene resin, 1, 2-polybutadiene, trans-polybutadiene, etc. are used as required, but the resin presently most popularly used is synthetic trans-polyisoprene (commercially available from Kuraray Co. Ltd. as TP-301). The hardness of this cover is preferably designed to be 70–85 by the JIS-C type hardness meter. The thickness of the cover is preferably is 0.6 to 2.0 mm.

EXAMPLES

The following Examples and Comparative Examples further illustrate the present invention in detail but are not to be constructed to limit the scope thereof.

Examples 1 to 4 and Comparative Examples 1 to 4

Using the liquid center of physical properties shown in Table 1, thread wound golf balls of Examples 1–4 were prepared in the number of dimples and total volume shown in Table 1. Using the liquid center of physical properties shown in Table 2, thread wound golf balls of Comparative Examples 1–4 were prepared in the number of dimples and total volume shown in Table 2.

Hardness of the center bag and ball weight are shown in Tables 1 and 2 in accordance with Examples and Comparative Examples, respectively. In manufacturing the liquid center, the details of formulation of paste, formulation for center bag, and formulation of rubber thread and cover will be later described.

The degree of deformation and flying performance of obtained balls are shown in Tables 1 and 2 in accordance with Examples and Comparative Examples, respectively. The measuring method of ball deformation degree and that for ball initial speed, spin, and carry are shown as follows.

Degree of Ball Deformation

The degree of deformation of ball (mm) is applied is measured from the point when the initial load 10 kg is applied to the point when the final load 130 kg. The harder the ball, the smaller the degree of ball deformation.

Initial Speed of Ball

Using a True Temper swing robot, the ball is hit by a metal head club at a head speed of 45 m/s and the initial speed is measured. The initial speed is measured for 24 balls and is expressed by the mean value.

Spin

Using a True Temper swing robot, the ball is hit by a metal head club at a head speed of 45 m/s and the spin is found by taking photographs of the hit balls. The spin is measured for 24 balls and is expressed by the mean value.

Carry

Using a True Temper swing robot, the ball is hit by a metal head club at a head speed of 45 m/s and the carry is measured. The carry is measured for 24 balls and is expressed by the mean value.

The carry is a distance at which the ball drops on the ground and the total shows the carry plus the distance (run) which the ball rolls after it drops.

TABLE 1

| | Examples | | | |
|---|---|---|---|---|
| | 1 | 2 | 3 | 4 |
| Liquid center diameter (mm) | 29.7 | 30.1 | 31.0 | 31.8 |
| Center bag thickness (mm) | 1.7 | 1.6 | 1.6 | 1.7 |
| Center bag hardness (JIS-A) | 51 | 51 | 52 | 52 |
| Number of dimples | 400 | 432 | 432 | 432 |
| Total dimple volume ($mm^3$) | 330 | 320 | 310 | 300 |
| Ball weight (g) | 45.5 | 45.3 | 45.4 | 45.4 |
| Degree of ball deformation (mm) | 2.64 | 2.64 | 2.77 | 2.80 |
| Initial ball speed (m/s) | 70.14 | 70.13 | 70.05 | 70.01 |
| Spin (rpm) | 2667 | 2516 | 2480 | 2445 |
| Carry (yard) | 247.7 | 249.7 | 248.7 | 248.9 |
| Total (yard) | 262.2 | 264.4 | 263.1 | 263.4 |
| Run (yard) | 14.9 | 14.7 | 14.4 | 14.5 |

TABLE 2

| | Comparative Examples | | | |
|---|---|---|---|---|
| | 1 | 2 | 3 | 4 |
| Liquid center diameter (mm) | 28.4 | 33.0 | 30.0 | 30.0 |
| Center bag thickness (mm) | 1.85 | 1.6 | 1.7 | 1.7 |
| Center bag hardness (JIS-A) | 51 | 50 | 52 | 52 |
| Number of dimples | 336 | 432 | 492 | 432 |
| Total dimple volume ($mm^3$) | 330 | 300 | 270 | 350 |
| Ball weight (g) | 45.3 | 45.4 | 45.3 | 45.3 |
| Degree of ball deformation (mm) | 2.58 | 2.89 | 2.72 | 2.73 |
| Initial ball speed (m/s) | 70.24 | 69.61 | 70.06 | 70.05 |
| Spin (rpm) | 2907 | 2385 | 2508 | 2498 |
| Carry (yard) | 245.2 | 244.4 | 243.7 | 236.2 |
| Total (yard) | 256.7 | 254.7 | 250.8 | 251.7 |
| Run (yard) | 11.5 | 10.3 | 7.1 | 15.5 |

As shown from the results shown in Tables 1 and 2, Examples 1–4 of the present invention exhibits reduced spin and increased carry as compared to Comparative Example 1 corresponding to conventional balls.

Comparative Example 1 shows a conventional standard thread wound golf ball, which has smaller diameter of liquid center than that of Examples 1–4 and provides faster initial speed but increases spin, and consequently, results in shorter carry than that of Examples 1–4.

Comparative Example 2 shows the case in which the liquid center diameter is excessively large and a large volume of rubber thread cannot be wound, and the center becomes too soft, causing large deformation of the ball. As a result, the initial ball speed becomes low and the ball is difficult to loft and results in a short carry.

Comparative Example 3 shows the case in which the liquid center diameter is designed to be within the range of the present invention; this reduces spin but because the total dimple volume is 270 $mm^3$, smaller than the range of the present invention, causing the ball to soar excessively high and shortening a carry.

Comparative Example 4 has the liquid center diameter held within the range of the present invention same as that of Comparative Example 3, resulting in reduced spin but because the total dimple volume is 350 $mm^3$, larger than the range of the present invention, the ball does not soar enough and does not provide an enough carry.

With respect to the above-mentioned Examples 1–4, when feeling (ball hitting feeling) and controllability were evaluated by five professional golfers, they reported that the thread wound golf balls according to the present invention provides feeling and controllability close to those of Comparative Example 1, which is a conventional standard thread wound golf ball, indicating that they have excellent feeling and controllability thread wound golf balls have.

That is, for the feeling, the ball was actually hit by professional golfers with a metal head driver and the feeling at the time of hitting the golf balls was compared with that of Comparative Example 1. They reported that Examples 1–4 provided feeling equal to that of Comparative Example 1 and maintained good feeling special to thread wound golf balls.

With respect to controllability, the ease to curve when professional golfers draw and fade the ball intentionally with a metal head driver and the ease to stop with a short iron were evaluated. Examples 1–4 curve less than Comparative Example 1 but has no significant difference in the ease to stop, indicating that the balls maintain good controllability special to thread wound golf balls.

The formulation of paste used for preparation of the liquid center, formulation for center bag, and formulation of rubber thread and cover are shown as follows. However, these are well known in the industry and shall not be constructed to limit the scope of the present invention.

① Formulation of Paste for Liquid Center

| | |
|---|---|
| Water | 88 parts by weight |
| Glycerin | 12 parts by weight |
| Clay | 20 parts by weight |
| Barium sulfate | 60–100 parts by weight (Specific gravity is adjusted as required in accordance with the center diameter so that the ball weight is adjusted to be 45.92 g or less which is the specified golf ball weight.) |

② Formulation for Center Bag

| | |
|---|---|
| Natural rubber | 100 parts by weight |
| Filler | 20–40 parts by weight (Specific gravity is adjusted as required.) |
| (Zinc oxide and calcium carbonate) | |
| Sulfur + curing accelerator | 4 parts by weight |

③ Rubber Thread

Elastic rubber thread made of blended rubber at a blending ratio of natural rubber to isoprene rubber of 30 to 70 and 0.5 mm thick and 1.5 mm wide is used.

④ Formulation for Cover

| | |
|---|---|
| Synthetic trans-polyisoprene | 80 parts by weight |
| High styrene resin | 10 parts by weight |
| Natural rubber | 10 parts by weight |
| Filler | 18 parts by weight |
| Sulfur + accelerator | 2 parts by weight |

As described above, according to the present invention, thread wound golf balls with large flying distance can be provided without losing good feeling of thread wound golf balls and good controllability while maintaining the initial speed limit range, by increasing the liquid center diameter to 29.5–32 mm from the conventional one and specifying the total dimple volume to 280–340 $mm^3$.

What is claimed is:

1. A thread wound golf ball comprising a liquid center, a rubber thread layer, formed on said liquid center, and a cover covering said rubber thread layer wherein said liquid center has a diameter of 29.5 to 32 mm and said cover has dimples thereon which have a total dimple volume of 280 to 340 $mm^3$.

2. A thread wound golf ball according to claim 1 wherein said liquid center comprises a center bag and a liquid material contained therein.

3. A thread wound golf ball according to claim 2 wherein said liquid material comprises water and a specific gravity controlling agent.

4. A thread wound golf ball according to claim 3 wherein said specific gravity controlling agent is selected from the group consisting of calcium carbonate, barium sulfate, zinc dioxide and mixtures thereof.

5. A thread wound golf ball according to claim 2 wherein said center bag is formed from a rubber composition comprising natural rubber and a specific gravity controlling agent.

6. A thread wound golf ball according to claim 2 wherein said center bag has a thickness of 1.5 to 2.0 mm and a hardness(JIS-A) of 40 to 60.

7. A thread wound golf ball according to claim 1 wherein said rubber thread layer is formed by winding thread rubber around said liquid center.

8. A thread wound golf ball according to claim 1 wherein a core comprising said liquid center and said rubber thread layer has a diameter of 38.8 to 41.5 mm.

9. A thread wound golf ball according to claim 1 wherein said cover has a hardness(JIS C) of 70 to 85 and a thickness of 0.6 to 2.0 mm.

10. A thread wound golf ball according to claim 1 wherein the number of dimples is 350 to 450.

* * * * *

US005421580B1

REEXAMINATION CERTIFICATE (3344th)

United States Patent [19]

[11] B1 5,421,580

Sugimoto et al.

[45] Certificate Issued Oct. 7, 1997

[54] THREAD WOUND GOLF BALLS

[75] Inventors: Kazushige Sugimoto; Keiji Moriyama, both of Akashi; Tadahiro Ebisuno, Nishinomiya; Mikio Yamada, Kobe, all of Japan

[73] Assignee: Sumitomo Rubber Industries, Ltd., Kobe, Japan

Reexamination Request:
No. 90/004,302, Jul. 15, 1996

Reexamination Certificate for:

| | |
|---|---|
| Patent No.: | **5,421,580** |
| Issued: | **Jun. 6, 1995** |
| Appl. No.: | **232,062** |
| Filed: | **Apr. 22, 1994** |

[30] Foreign Application Priority Data

Apr. 27, 1993 [JP] Japan ..... 5-124944

[51] Int. Cl.[6] ..... A63B 37/08; A63B 37/14

[52] U.S. Cl. ..... 473/354; 473/383; 473/378

[58] Field of Search ..... 473/354, 378, 473/383

[56] References Cited

U.S. PATENT DOCUMENTS

| | | | |
|---|---|---|---|
| 4,792,141 | 12/1988 | Llort | 473/378 |
| 4,943,332 | 7/1990 | Sakaguchi et al. | 473/354 X |

OTHER PUBLICATIONS

JIS "Method of Testing Physical Properties of Vulcanized Rubber", JIS K 6301 — 1969.

*Primary Examiner*—George J. Marlo

[57] ABSTRACT

Disclosed is a thread wound golf ball comprising a liquid center, rubber thread layer formed on said liquid center, and a cover covering said rubber thread layer wherein said liquid center has a diameter of [29.5] *31* to 32 mm and said cover has dimples thereon which have total dimple volume of 280 to 340 $mm^3$.

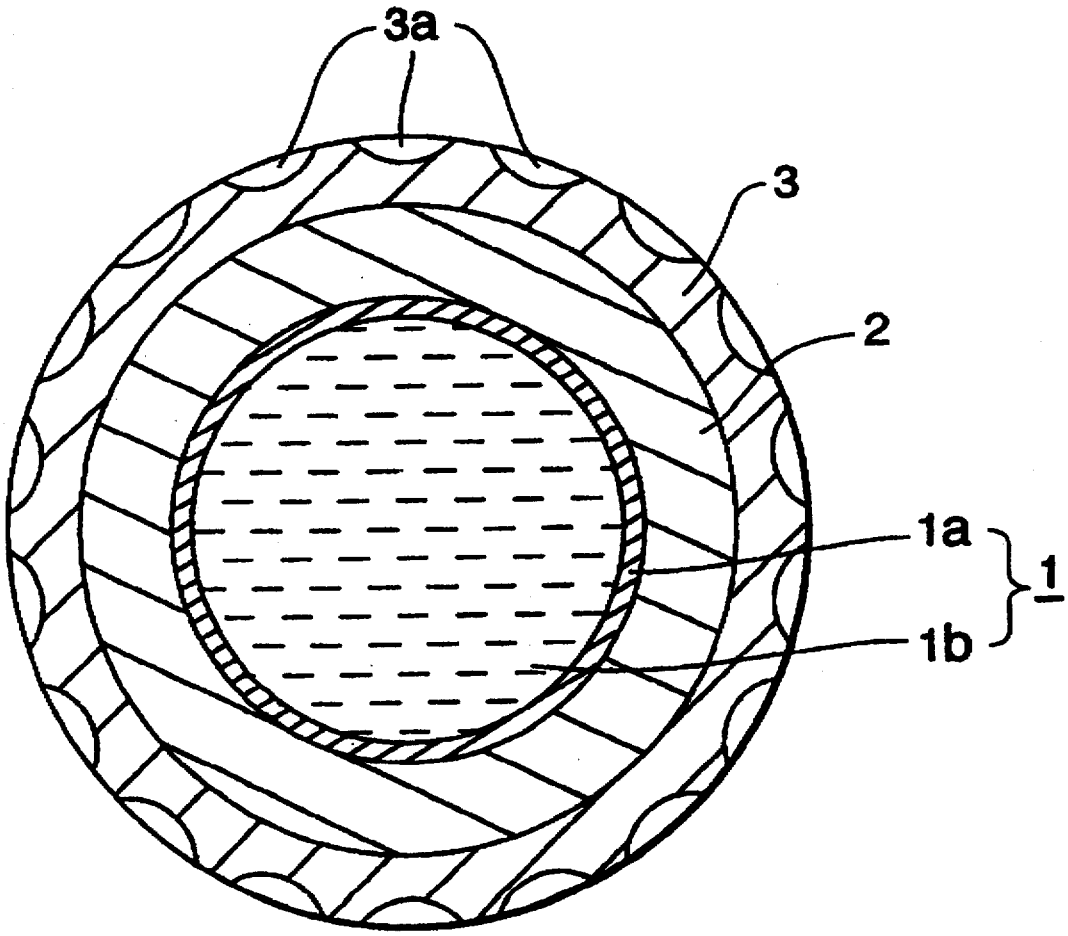

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-10, dependent on an amended claim, are determined to be patentable.

New claim 11 is added and determined to be patentable.

1. A thread wound golf ball comprising a liquid center, a rubber thread layer, formed on said liquid center, and a cover covering said rubber thread layer wherein said liquid center has a diameter of [29.5] *31.0* to 32 mm and said cover has dimples thereon which have a total dimple volume of 280 to 340 $mm^3$.

*11. A thread wound golf ball according to claim 1 wherein said cover has a total dimple volume of 280 to 320 $mm^3$.*

* * * * *